US010822857B2

(12) United States Patent
Hall et al.

(10) Patent No.: US 10,822,857 B2
(45) Date of Patent: Nov. 3, 2020

(54) RETROFITTABLE MOTORIZED GEAR SLIDING WINDOW OR DOOR SYSTEM

(71) Applicants: David R. Hall, Provo, UT (US); Jerome Miles, Spanish Fork, UT (US); Nathan Davis, Bountiful, UT (US)

(72) Inventors: David R. Hall, Provo, UT (US); Jerome Miles, Spanish Fork, UT (US); Nathan Davis, Bountiful, UT (US)

(73) Assignee: Hall Labs LLC, Provo, UT (US)

( * ) Notice: Subject to any disclaimer, the term of this patent is extended or adjusted under 35 U.S.C. 154(b) by 170 days.

(21) Appl. No.: 15/822,394

(22) Filed: Nov. 27, 2017

(65) Prior Publication Data

US 2019/0003235 A1 Jan. 3, 2019

Related U.S. Application Data

(60) Provisional application No. 62/528,288, filed on Jul. 3, 2017.

(51) Int. Cl.
*E05F 15/635* (2015.01)
*E05F 15/77* (2015.01)

(52) U.S. Cl.
CPC ..... *E05F 15/635* (2015.01); *E05F 15/77* (2015.01)

(58) Field of Classification Search
CPC ..... E05F 15/635; E05F 15/643; E05F 15/77; E05Y 2201/722; E05Y 2800/70; E05Y 2900/132
See application file for complete search history.

(56) References Cited

U.S. PATENT DOCUMENTS 1,757,751 A * 5/1930 Strauss ..... E05F 15/665 49/361
2,531,116 A * 11/1950 Donoghue ..... E05F 15/71 49/23
3,237,250 A * 3/1966 Scoville ..... E05F 11/53 49/136
3,241,283 A * 3/1966 Ahlgren ..... E06B 3/4609 49/425
5,261,187 A * 11/1993 Prenger ..... E05F 15/635 49/362
5,351,441 A * 10/1994 Hormann ..... E06B 11/045 49/362
5,355,624 A * 10/1994 Bacon ..... E05F 15/635 49/280
5,515,650 A * 5/1996 Machill ..... E06B 11/045 49/362
5,680,729 A * 10/1997 Heffington ..... E05F 15/53 49/362

(Continued)

*Primary Examiner* — Justin B Rephann

(57) ABSTRACT

Devices, systems, and methods for a frame with a slidable segment are disclosed. The slidable segment is slidably mounted within the frame. A first motor is coupled to the slidable segment. The first motor has a first gear affixed to and driven by the first motor. A first gear track may be mounted to a first horizontal member of the frame, wherein teeth of the first gear align with tooth spaces of the first gear track. Rotating the first gear in a first rotational direction causes the first gear to pull the slidable segment in a first linear direction as the first gear walks along the first gear track. Rotating the first gear in a second rotational direction causes the first gear to pull the slidable segment in a second linear direction as the first gear walks along the first gear track.

12 Claims, 6 Drawing Sheets

(56) References Cited

U.S. PATENT DOCUMENTS

| | | | | |
|---|---|---|---|---|
| 6,055,775 | A * | 5/2000 | Dering | E05F 1/1091 49/340 |
| 6,091,217 | A * | 7/2000 | Parsadayan | E05F 15/41 318/283 |
| 6,233,878 | B1 * | 5/2001 | Krahenbuhl | E05F 15/632 52/64 |
| 6,267,168 | B1 * | 7/2001 | Davies | E05D 15/0604 160/23.1 |
| 6,481,160 | B1 * | 11/2002 | Kowalczyk | E05F 3/224 49/333 |
| 6,581,332 | B1 * | 6/2003 | Kim | E05F 15/77 49/358 |
| 8,474,186 | B2 * | 7/2013 | Dufour | B60J 1/1853 49/380 |
| 8,595,977 | B2 * | 12/2013 | Hancock | E05F 15/635 49/349 |
| 8,931,216 | B2 * | 1/2015 | Gazda | E05D 15/0656 52/64 |
| 2001/0011579 | A1 * | 8/2001 | Davies | E05D 15/0604 160/23.1 |
| 2006/0150520 | A1 * | 7/2006 | Hamazaki | E05B 65/08 49/449 |
| 2008/0163553 | A1 * | 7/2008 | Liao | E05F 11/423 49/362 |
| 2012/0023827 | A1 * | 2/2012 | Hancock | E05F 15/635 49/360 |
| 2014/0047768 | A1 * | 2/2014 | Vaknin | E05D 15/06 49/25 |
| 2015/0020617 | A1 * | 1/2015 | Neumann | F16H 19/04 74/30 |
| 2017/0101816 | A1 * | 4/2017 | Kozonasky | E05F 15/77 |
| 2018/0355660 | A1 * | 12/2018 | Noy | E05D 15/0665 |
| 2018/0363356 | A1 * | 12/2018 | Hohwart | E05F 15/635 |

* cited by examiner

RETROFITTABLE MOTORIZED GEAR SLIDING WINDOW OR DOOR SYSTEM

RELATED APPLICATIONS

This application is a continuation-in-part of U.S. Patent Application No. 62/528,288, filed Jul. 3, 2017, which is hereby incorporated by reference herein in its entirety.

FIELD OF THE INVENTION

The devices, systems, and methods described herein relate generally to the Internet of Things. More particularly, the devices, systems, and methods described herein relate to smart home devices.

BACKGROUND

Many improvements and developments have been made in the field of Smart Home devices. However, many devices, especially existing devices (such as windows and doors, for example) in a residence or business, simply aren't smart and/or weren't designed to be smart. It is desirable to be able to convert otherwise dumb devices into smart devices.

SUMMARY

Devices, systems, and methods for a frame with a slidable segment are disclosed. The slidable segment (e.g., a window or door) is slidably mounted within the frame (e.g., a window frame or a door frame). A first motor is coupled to the slidable segment. The first motor has a first gear affixed to and driven by the first motor. A first gear track may be mounted to a first horizontal member of the frame, wherein teeth of the first gear align with tooth spaces of the first gear track. Rotating the first gear in a first rotational direction causes the first gear to pull the slidable segment in a first linear direction as the first gear walks along the first gear track. Rotating the first gear in a second rotational direction causes the first gear to pull the slidable segment in a second linear direction as the first gear walks along the first gear track.

A second motor may be coupled to the slidable segment, with a second gear affixed to and driven by the second motor and a second gear track mounted to the other horizontal member of the frame. Teeth of the second gear may align with tooth spaces of the second gear track. The first gear and the second gear may be oriented anti-parallel to each other such that rotating the second gear in the second rotational direction causes the second gear to pull the slidable segment, in conjunction with the first gear, in the first linear direction as the second gear walks along the second gear track, and rotating the second gear in the first rotational direction causes the second gear to pull the slidable segment, in conjunction with the first gear, in the second linear direction as the second gear walks along the second gear track.

The first horizontal member may be a bottom horizontal member of the frame and the second horizontal member may be a top horizontal member of the frame. The frame may be a window frame or a door frame. The frame may have a fixed segment offset from the slidable segment such that the slidable segment can slide past the fixed segment.

The first motor may include one or more communication systems, including Bluetooth communication chips, Internet Wi-Fi transceivers, network transceivers, a Z-Wave network transceiver, or a combination thereof. The one or more communication systems may communicate with an external remote controller. The one or more communication systems may receive instructions from the external remote controller, generate signals instructing the first motor to rotate in a direction, receive signals from the first motor regarding a status of the first motor, and generate a signal informing the external remote controller of the status of the first motor.

BRIEF DESCRIPTION OF THE DRAWINGS

In order that the advantages of the described devices, systems, and methods will be readily understood, a more particular description of the described devices, systems, and methods briefly described above will be rendered by reference to specific embodiments illustrated in the appended drawings. Understanding that these drawings depict only typical embodiments of the described devices, systems, and methods and are not therefore to be considered limiting of its scope, the devices, systems, and methods will be described and explained with additional specificity and detail through use of the accompanying drawings, in which.

DETAILED DESCRIPTION

It will be readily understood that the components of the described devices, systems, and methods, as generally described and illustrated in the Figures herein, could be arranged and designed in a wide variety of different configurations. Thus, the following more detailed description of the embodiments of the described devices, systems, and methods, as represented in the Figures, is not intended to limit the scope of the described devices, systems, and methods, as claimed, but is merely representative of certain examples of presently contemplated embodiments in accordance with the described devices, systems, and methods.

Automatic opening and closing of sliding windows and sliding doors generally requires planning ahead and use of frames that are designed specifically for automatic sliding doors and automatic sliding windows. However, when automation of an existing installation is desired, a complete replacement of the existing frame is costly and requires more construction skill than the typical homeowner possesses. The devices, systems, and methods disclosed herein disclosed provide solutions to this issue. A motor installed on the sliding segment of the door or window is coupled by a gear to a gear track (as in a rack and pinion). The gear track is attached to one of the horizontal members of the frame. Rotation of the gear walks the gear along the gear track, causing the sliding segment to move from closed to open and back again. This solution is cost effective and requires minimal construction skill.

Figure 1A:
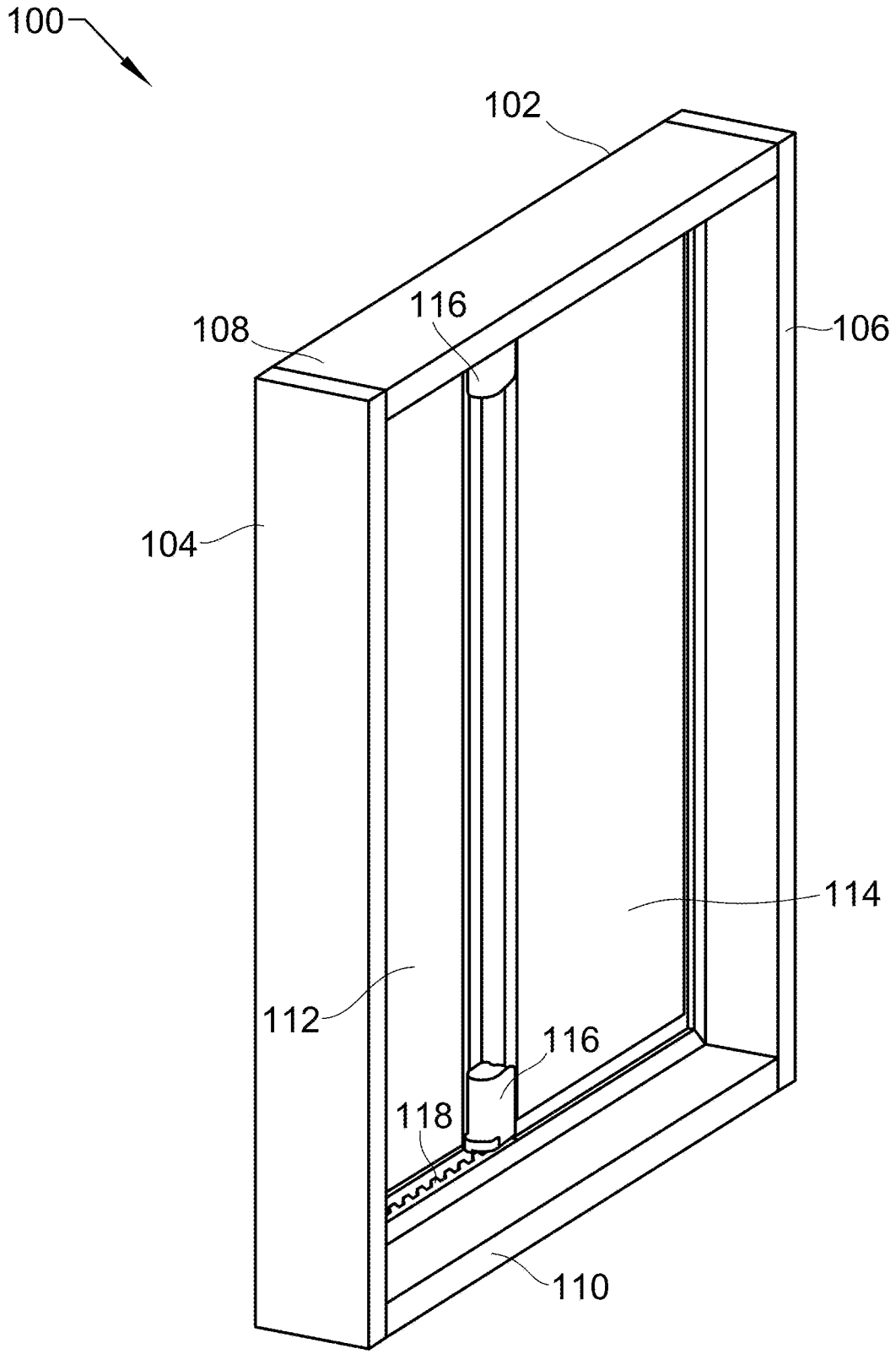
FIG. 1A shows an isometric top-left view of a motorized sliding segment in a frame.
Figure 1B:
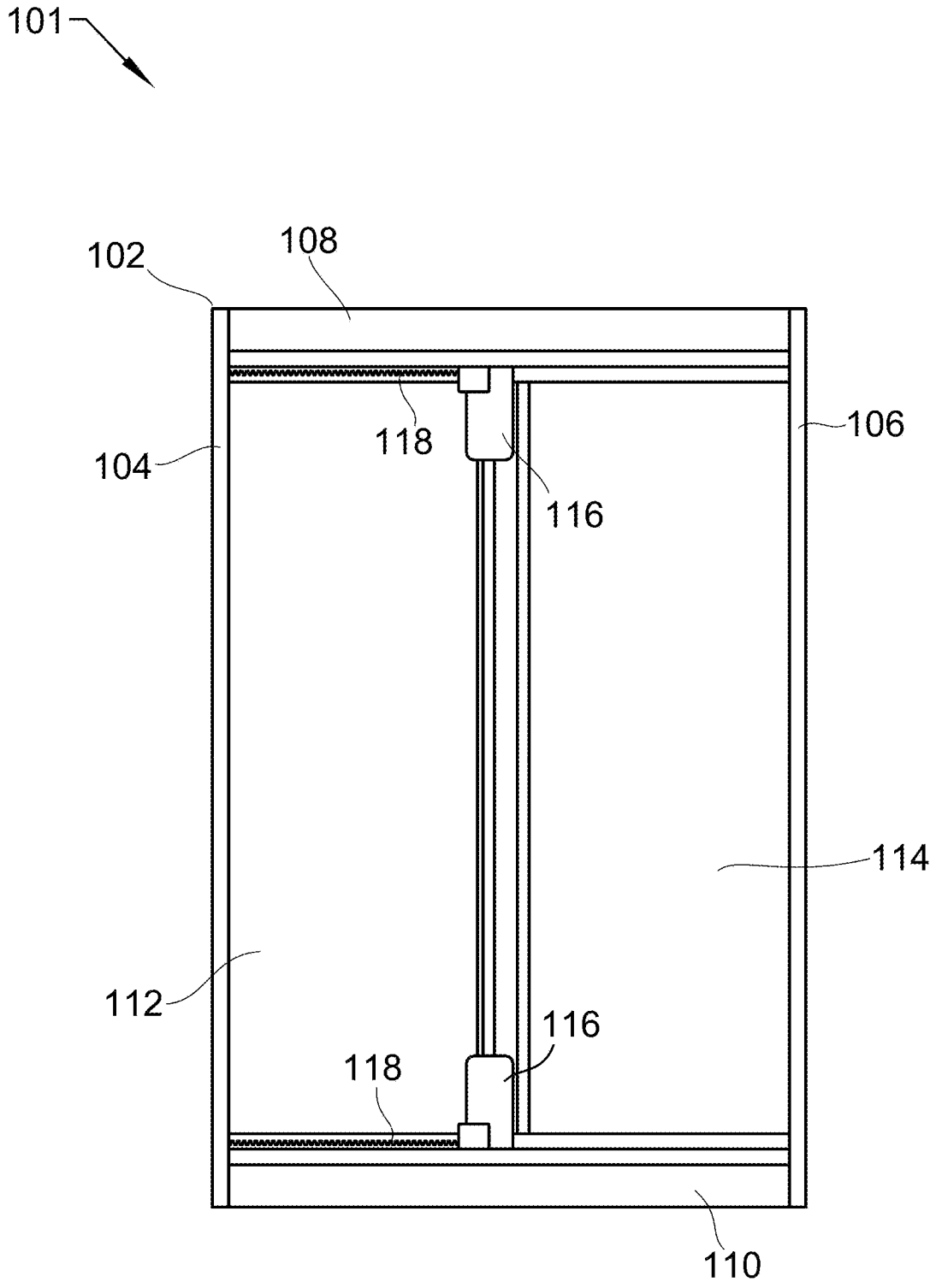
FIG. 1B shows a front isometric view of the frame of FIG. 1A.

Referring now to the Figures, FIG. 1A shows an isometric top-left view 100 of a motorized sliding segment 114 mounted slidably in a frame 102 that may be used in the described devices, systems, and methods. FIG. 1B shows a front isometric view of the frame of FIG. 1A. The frame 102 may be a window frame or a door frame. The frame includes a fixed segment 112, top horizontal member 108, bottom horizontal member 110, left vertical member 104, and right vertical member 106. The track for the sliding segment 114 is offset from the fixed segment 112 so that the sliding segment can open and close. It is appreciated that before the addition of any motor assemblies 116, the sliding segment 114 is manually operated (the sliding segment 114 and frame 102 may be "dumb" or non-smart devices).

Motor assemblies 116 are affixed to the top and/or bottom of the left side of the sliding segment 114. Although two motor assemblies 116 are shown in FIG. 1, any number of motor assemblies 116 may be used, including just one as illustrated in FIG. 3. While the left side is identified, it is appreciated that a motor assembly 116 may be affixed to any location on the sliding segment 114 without departing from the scope of the present systems, devices, and methods. Motor assemblies 116 contain a motor and a gear, as described in FIG. 2. Gear tracks 118 are affixed to the top and bottom horizontal members 108 and 110. The gears mesh with the teeth of the gear tracks 118. The motors turn the gears in a first direction, causing the gears to walk along the gear tracks 118, causing the slidable segment 114 to slide towards this vertical member. Rotation the opposite direction walks the gears the other direction, pulling the slidable segment the other direction. In the present instance, the motor assemblies 116 are mirror images of one another, and so the motors turn opposite each other to walk the same direction. In other words, the motors are antiparallel to each other.

Figure 2:
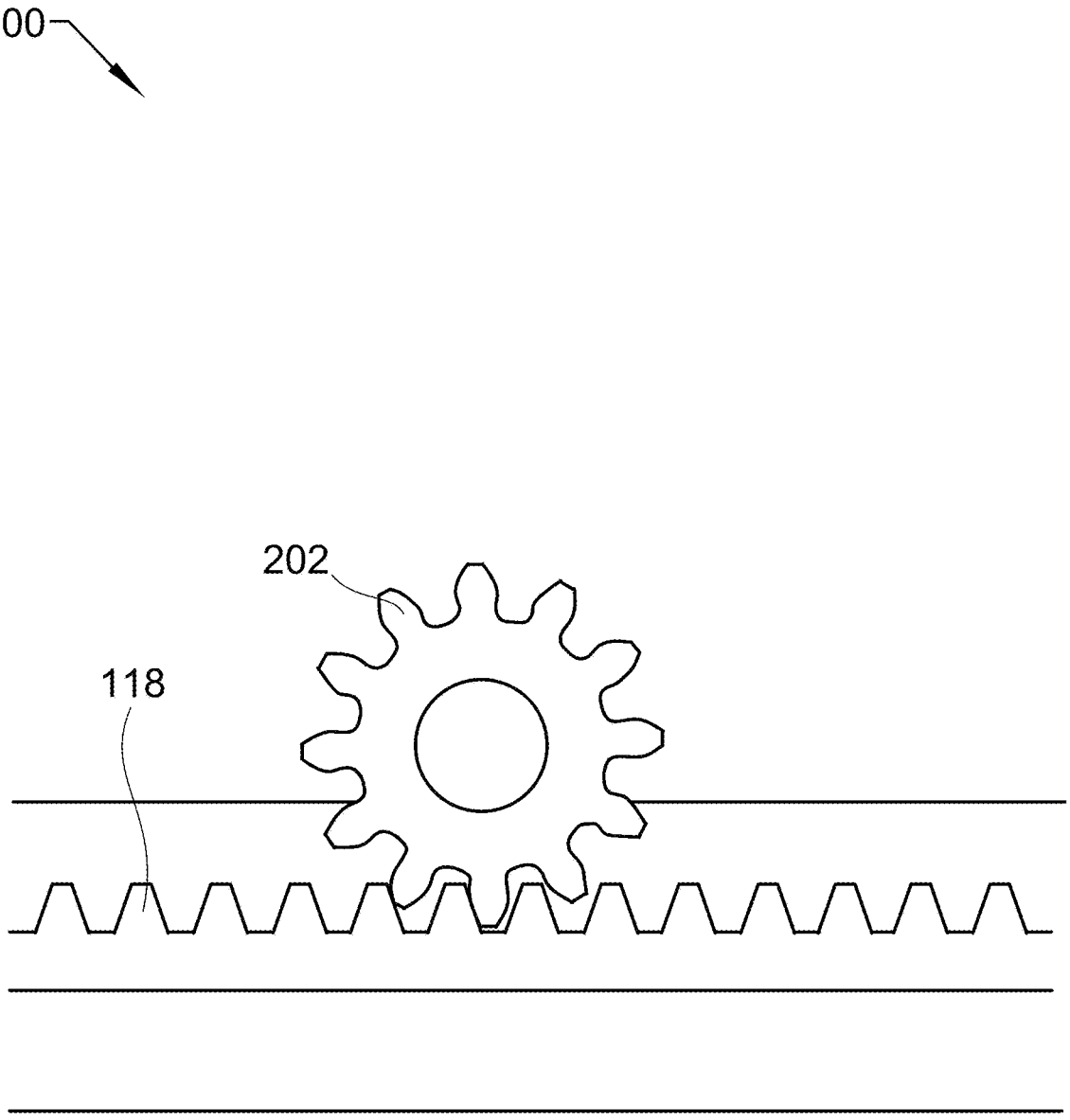
FIG. 2 shows an isometric view of one of the motor/pulley assemblies of FIG. 1A.

Referring to FIG. 2, FIG. 2 shows a cutaway cross-sectional isometric view 200 of one of the gear tracks 118 of FIG. 1A with its associated gear 202. The gear 202 turns, the teeth engaging the gear track 118. As the gear track 118 is affixed to one of the horizontal members, this forces the slidable segment 114 to slide open or closed.

Figure 3A:
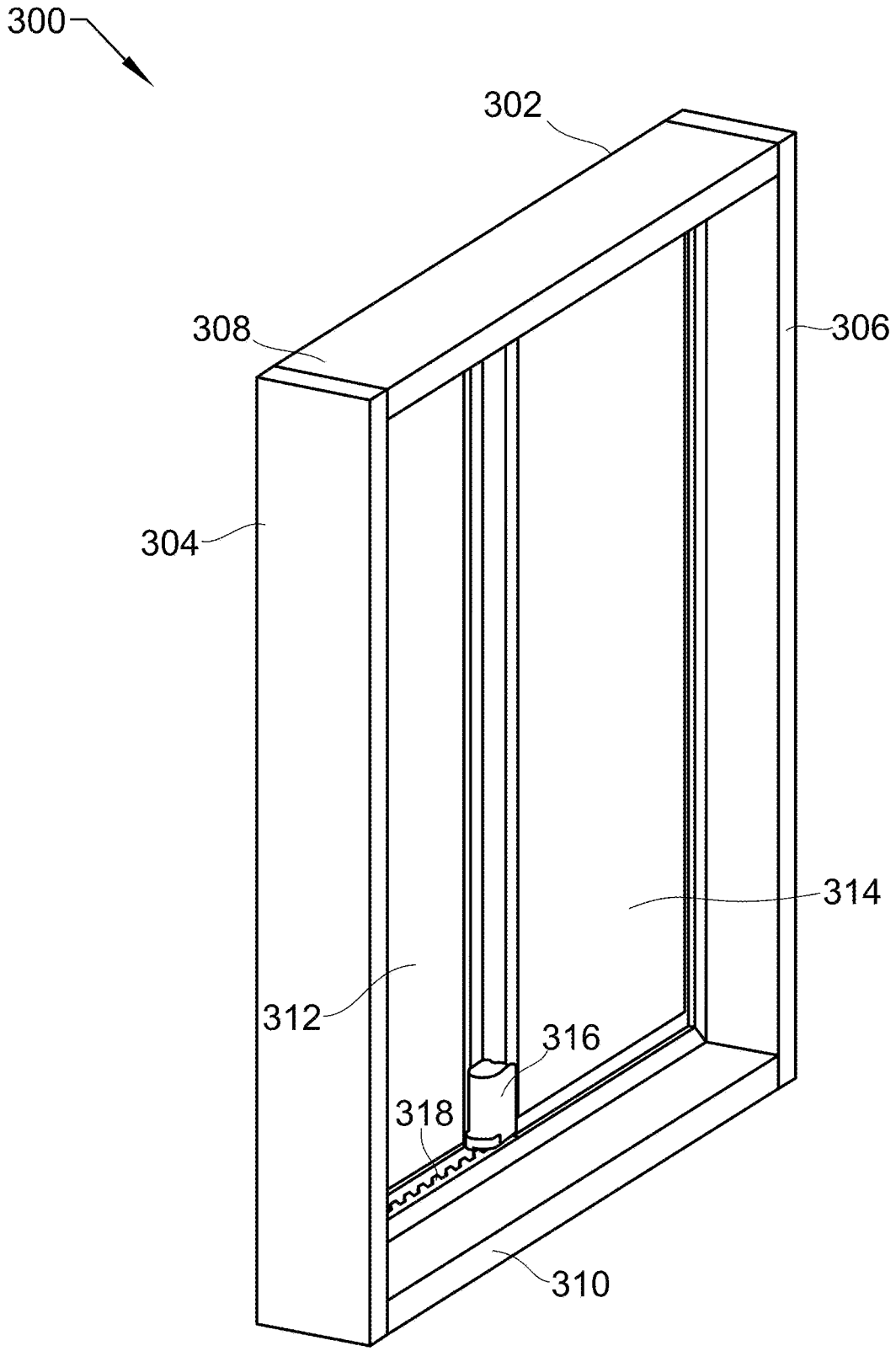
FIG. 3A shows an isometric top-left view of a motorized sliding segment in a frame.
Figure 3B:
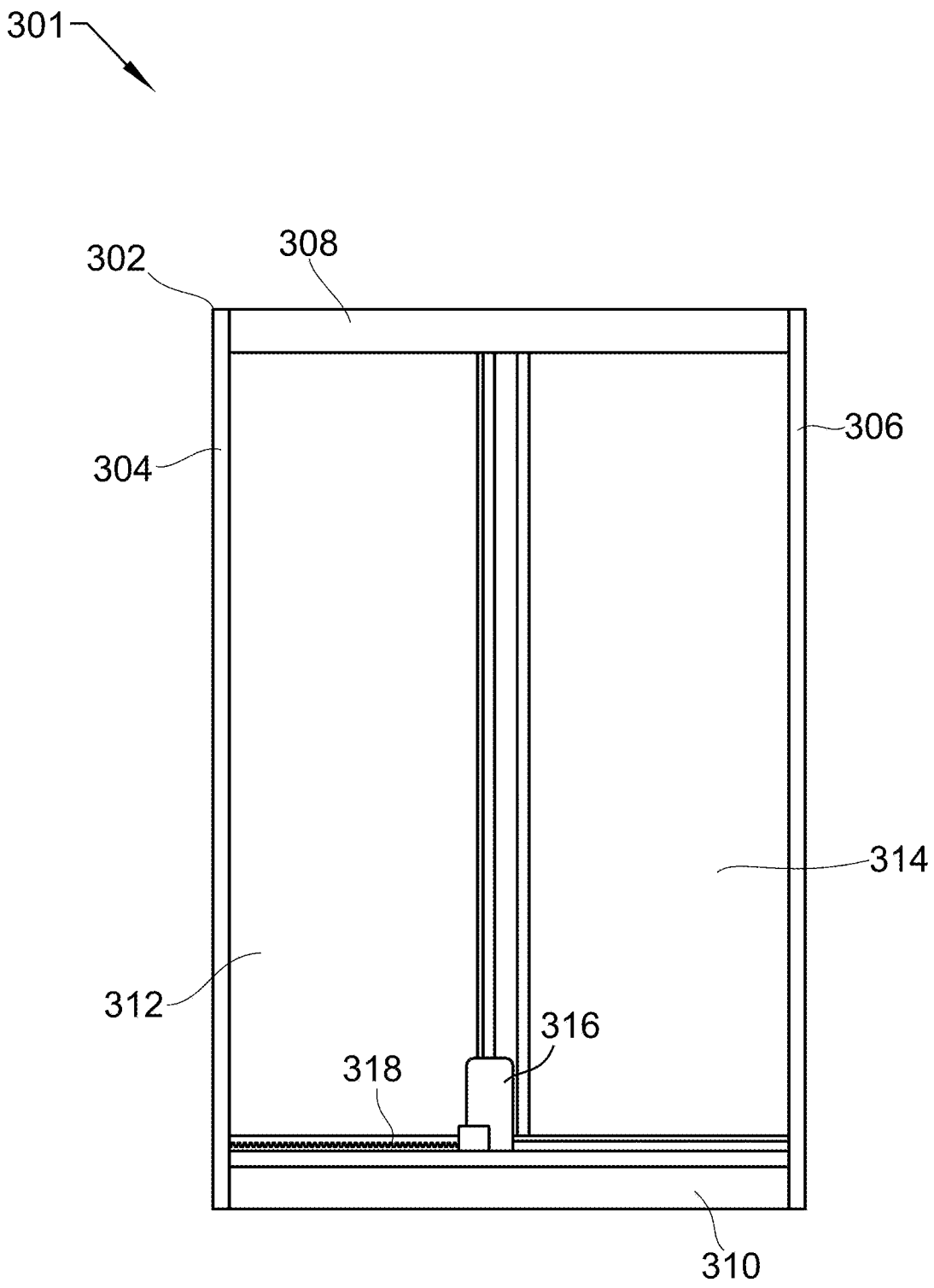
FIG. 3B shows a front isometric view of the frame of FIG. 3A.

Referring now to the Figures, FIG. 3A shows an isometric top-left view 300 of a motorized sliding segment 314 mounted slidably in a frame 302 that may be used in the described devices, systems, and methods. FIG. 3B shows a front isometric view of the frame of FIG. 3A. The frame 302 may be a window frame or a door frame. The frame includes a fixed segment 312, top horizontal member 308, bottom horizontal member 310, left vertical member 304, and right vertical member 306. The track for the sliding segment 314 is offset from the fixed segment 312 so that the sliding segment can open and close.

Motor assembly 316 is affixed to the bottom of the left side of the sliding segment 314. Motor assembly 316 contains a motor and a gear, as described in FIG. 2. A gear track 318 is affixed to the bottom horizontal member 310. The gear meshes with the teeth of the gear track 318. The motor turns the gear in a first direction, causing the gear to walk along the gear track 318, causing the slidable segment 314 to slide towards this vertical member. Rotation the opposite direction walks the gear the other direction, pulling the slidable segment the other direction.

In some embodiments, the motor assembly 316 includes a transmission (not shown). The transmission may include one or more gears that convert rotational speed to rotational torque for driving the gear that meshes with the teeth of the gear track. In some cases, the transmission is configured such that the transmission can only be driven by the motor of the motor assembly 316 (cannot be driven by the gear, for example). For instance, the transmission may include a worm gear that may be driven by the motor to drive the gear, but that locks the gear in place when the motor is not spinning (the gear cannot be used to turn the worm gear, for example). Thus, the transmission locks the slidable segment 314 in place in whatever position the slidable segment 314 is in. So in contrast to typical locking mechanisms that only lock a slidable segment when the slidable segment is in a closed position, the transmission locks the gear in place in the teeth of the gear track in whatever place in the gear track that the gear is at. So the slidable segment 314 may be locked in place when the slidable segment 314 is closed as with typical locking mechanisms but could also lock the slidable segment 314 in place when the slidable segment 314 is any degree of partly open or even fully opened. This feature may allow for the slidable segment 314 to be partly opened, while still providing security that the slidable segment 314 cannot be opened further or closed outside of an authorized user's control (when the motor is driven, for example).

Figure 4:
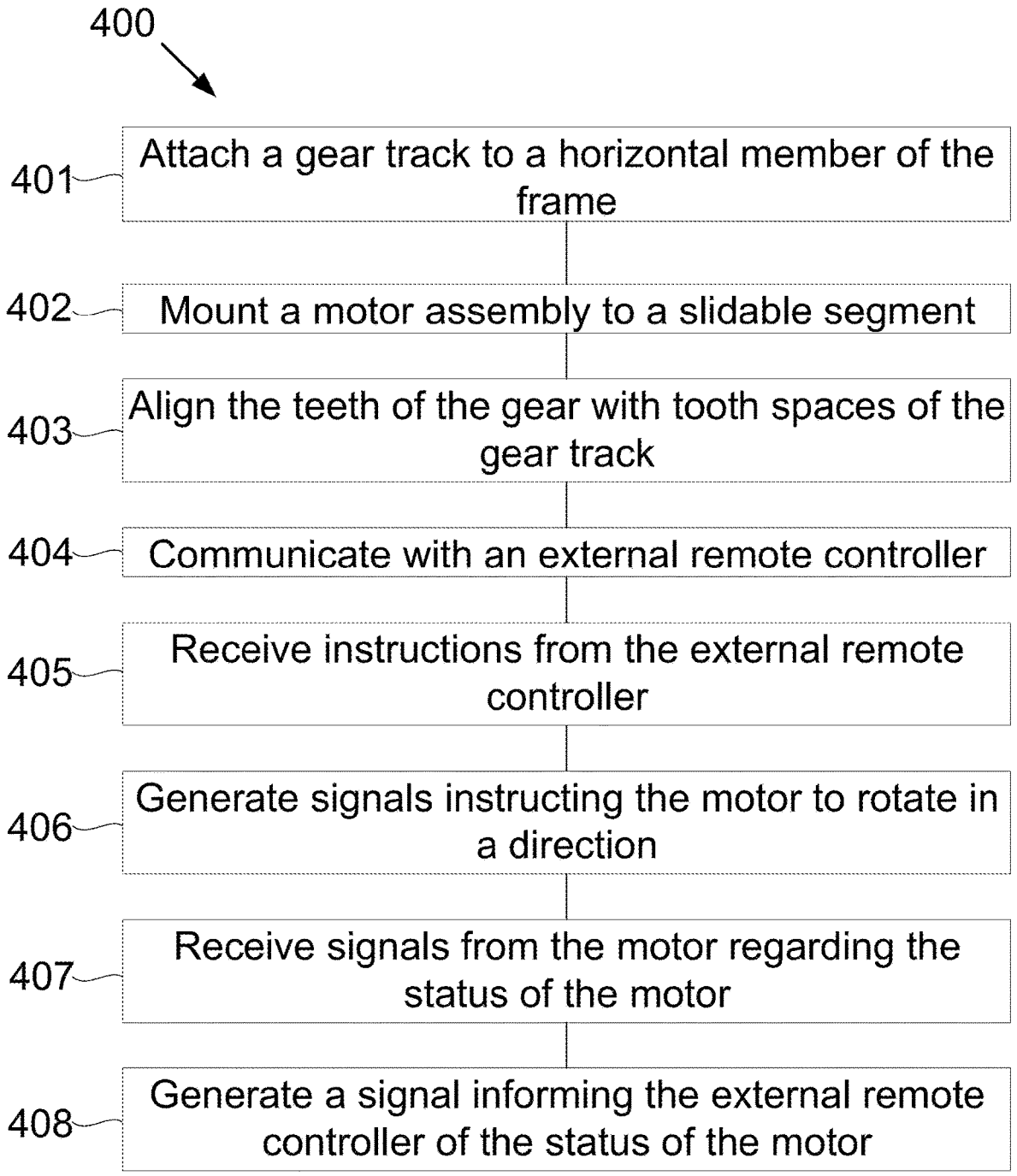
FIG. 4 shows a method for automating a slidable segment of a frame.

Referring to FIG. 4, FIG. 4 shows a method 400 for automating a slidable segment of a frame using the described devices, systems, and methods. At 401, a gear track is attached to a horizontal member of the frame. At 402, a motor assembly is mounted to a slidable segment, the slidable segment being slidably mounted within the frame. The motor assembly comprises a motor turning a gear. At 403, the teeth of the gear are aligned with tooth spaces of the gear track. The motor has one or more communication systems. At 404, the one or more communication systems communicate with an external remote controller. At 405, the one or more communication systems receive instructions from the external remote controller. At 406, the one or more communication systems generate signals instructing the motor to rotate in a direction. At 407, the one or more communication systems receive signals from the motor regarding a status of the motor. At 408, the one or more communication systems generate a signal informing the external remote controller of the status of the motor.

Although the operations of method 400 are illustrated as being performed in a particular order, it is understood that the operations of method 400 may be reordered without departing from the scope of the method.

In some embodiments, the motor includes one or more communication systems. These may include Bluetooth communication chips, Internet Wi-Fi transceivers, network transceivers, a Z-Wave network transceiver, or a combination thereof. In some embodiments, the one or more communication systems communicate with an external remote controller. In some embodiments, the one or more communication systems receive instructions from the external remote controller, generate signals instructing the motor to rotate in a direction, receive signals from the motor regarding a status of the first motor, and generate a signal informing the external remote controller of the status of the motor.

In some embodiments, the motor has and is powered by one or more batteries. In other embodiments, the motor has and is powered by a power line.

In some embodiments, the slidable segment is slidably mounted by being between tracks on a top horizontal member of the frame and a bottom horizontal member of the frame, the tracks allowing the slidable frame to freely move side to side.

In some embodiments, the frame has a latching device that mates to a latching receiver attached to the slidable segment, wherein mating prevents movement of the slidable segment. In some embodiments, the latching receiver comprises a communication device that generates a signal when the latching device is mated and transmits that signal to the motor, wherein the signal deactivates the motor.

In some embodiments, the first gear track is attached to the horizontal member of the frame by adhesive, screws, nails, or a combination thereof. In some embodiments, the first motor assembly is mounted to the slidable segment by adhesive, screws, nails, or a combination thereof.

In some embodiments, the first gear track is attached in the track that the slidable segment slides in. In other embodiments, the first gear track is attached adjacent to the track that the slidable segment slides on.

The invention claimed is:

1. A device comprising:

a frame and a slidable segment that is slidably mounted within the frame, a first motor coupled to the slidable segment, a first gear affixed to and driven by the first motor, a first gear track mounted to a first horizontal member of the frame, wherein teeth of the first gear align with tooth spaces of the first gear track, wherein rotating the first gear in a first rotational direction causes the first gear to pull the slidable segment in a first linear direction as the first gear walks along the first gear track, and wherein rotating the first gear in a second rotational direction causes the first gear to pull the slidable segment in a second linear direction as the first gear walks along the first gear track; and a latching device with one part configured to be attached to the frame and an other part configured to be attached to the slidable segment, wherein, when engaged, the latching device mating prevents movement of the slidable segment sliding window; and wherein the latching device comprises a communication device that generates a signal when the latching device is engaged and transmits that signal to the first motor, wherein the signal deactivates the first motor.

2. The device of claim 1, wherein the communication device comprises one or more communication systems comprising Bluetooth communication chips, Internet Wi-Fi transceivers, network transceivers, a Z-Wave network transceiver, or a combination thereof, and wherein the one or more communication systems communicate with an external remote controller.

3. The device of claim 2, wherein the one or more communication systems receive instructions from the external remote controller, generate signals instructing the first motor to rotate in the first or second direction, receive signals from the first motor regarding a status of the first motor, and generate a signal informing the external remote controller of the status of the first motor.

4. The device of claim 1, wherein the first motor includes a transmission that drives the first gear, wherein the transmission prevents the first gear from rotating when the transmission is not driven by the first motor such that the transmission locks the slidable segment in place when the transmission is not driven by the first motor.

5. The device of claim 4, wherein the transmission comprises a worm gear.

6. The device of claim 1, wherein the first motor further comprises one or more batteries and is powered by the one or more batteries.

7. The device of claim 1, wherein the first motor further comprises a power line and is powered by the power line.

8. The device of claim 1, wherein the first motor is configured to be attached to a top side of the slidable segment, wherein the first gear track is configured to be attached to a top horizontal member of the window frame, and further comprising a second motor attached to a bottom side of the slidable segment and further comprising a second gear driven by the second motor, and further comprising a second gear track configured to be attached to a bottom horizontal member of the frame and comprising teeth shaped to mesh with the second gear.

9. The device of claim 1, further comprising an adhesive on the first motor for attaching to the slidable segment.

10. The device of claim 1, further comprising screws for attaching the first motor to the slidable segment.

11. The device of claim 1, further comprising an adhesive on the first gear track for attaching to the first horizontal member.

12. The device of claim 1, further comprising screws for attaching to the first gear track to the frame.

* * * * *